US007137453B2

(12) United States Patent
Gustafson et al.

(10) Patent No.: US 7,137,453 B2
(45) Date of Patent: Nov. 21, 2006

(54) REMOTE OPERATED ACTUATOR SYSTEM FOR DRILL STRING INTERNAL BLOWOUT PREVENTER

(75) Inventors: Ryan Gustafson, Houston, TX (US); Jonathan Bowen, Houston, TX (US)

(73) Assignee: Hydril Company L.P., Houston, TX (US)

( * ) Notice: Subject to any disclaimer, the term of this patent is extended or adjusted under 35 U.S.C. 154(b) by 287 days.

(21) Appl. No.: 10/818,607

(22) Filed: Apr. 6, 2004

(65) Prior Publication Data

US 2005/0217862 A1 Oct. 6, 2005

(51) Int. Cl.
*E21B 19/16* (2006.01)
*E21B 33/06* (2006.01)

(52) U.S. Cl. ..... 166/378; 166/85.4; 166/363; 175/195

(58) Field of Classification Search ..... None
See application file for complete search history.

(56) References Cited

U.S. PATENT DOCUMENTS 3,661,204 A * 5/1972 Blanding et al. ..... 166/356
3,792,601 A * 2/1974 Dillingham et al. ..... 72/76
4,416,340 A * 11/1983 Bailey ..... 175/195
4,423,774 A * 1/1984 Mefford ..... 166/77.51
4,594,030 A * 6/1986 Weigel, Jr. ..... 408/10
5,692,418 A * 12/1997 Burner ..... 81/54

* cited by examiner

*Primary Examiner*—Zakiya W. Bates
(74) *Attorney, Agent, or Firm*—Osha Liang LLP

(57) ABSTRACT

An air swivel ring includes a non-rotating member having an air inlet, a rotating member having an air outlet, and a split seal having a first sealing surface and coupled to one of the non-rotating member and the rotating member so that the first sealing surface on the seal is disposed proximate a second sealing surface on the other of the non-rotating member and the rotating member.

9 Claims, 5 Drawing Sheets

REMOTE OPERATED ACTUATOR SYSTEM FOR DRILL STRING INTERNAL BLOWOUT PREVENTER

BACKGROUND OF INVENTION

Well control is an important aspect of oil and gas exploration. When drilling a well, for example, in oil and gas exploration applications, safety devices must be put in place to prevent injury to personnel and damage to equipment resulting from unexpected events associated with the drilling activities.

Drilling wells in oil and gas exploration involves penetrating a variety of subsurface geologic structures, or "layers." Occasionally, a wellbore will penetrate a layer having a formation pressure substantially higher than the pressure maintained in the wellbore. When this occurs, the well is said to have "taken a kick." The pressure increase associated with the kick is generally produced by an influx of formation fluids (which may be a liquid, a gas, or a combination thereof) into the wellbore. The relatively high pressure kick tends to propagate from a point of entry in the wellbore uphole (from a high pressure region to a low pressure region). If the kick is allowed to reach the surface, drilling fluid, well tools, and other drilling structures may be blown out of the wellbore. These "blowouts" often result in catastrophic destruction of the drilling equipment (including, for example, the drilling rig) and substantial injury or death of rig personnel.

Because of the risk of blowouts, blowout preventers ("BOP") are typically installed at the surface or on the sea floor in deep water drilling arrangements to effectively seal a wellbore until active measures can be taken to control the kick. Blowout preventers may be activated so that kicks may be adequately controlled and circulated out of the system.

Just as a kick will propagate up the well, it may also enter the drill string and propagate through the inside of the drill string. To control a kick inside the drill string, a drill string internal blowout preventer ("IBOP"), sometimes called a "kelly valve" or a "kelly cock," is used to seal off the drill string until measures can be taken to control the kick. (An IBOP is sometimes called a "kelly valve" because, on older-style rigs, the IBOP was typically located near the "kelly," which is a non-circular part of the drill string that is used to impart rotary motion to the drill string.)

An IBOP is typically a ball valve or other type of valve that is connected in line with the drills string. It can be closed to isolate the kick inside the drill string. Because an IBOP and its associated actuator is connected in line with the drill string, it will rotate with the drill string during drilling operations. Typically, IBOP's are pneumatically powered. The air source, typically a pressurized cylinder, is generally stationary. Thus, the challenge is to get the air power from the stationary source to the rotating IBOP actuator. It is noted that often drilling is stopped before the IBOP is actuated, but for safety reasons, the IBOP must be connected to an air supply at all times during drilling operations.

Prior art IBOP actuators have included a rotating section and a non-rotating section. Generally, the air source is routed into the non-rotating section, which is coupled to the rotation portion of the actuator by various types of seals, bearings, and air passageways. The air passes into the rotating portion of the actuator where it powers the actuator to close the IBOP.

SUMMARY OF INVENTION

In some embodiments, the invention relates to an air swivel ring that includes a non-rotating member having an air inlet, a rotating member having an air outlet, and a split seal having a first sealing surface and coupled to one of the non-rotating member and the rotating member so that a first sealing surface on the seal is disposed proximate a second sealing surface on the other of the non-rotating member and the rotating member.

In other embodiments, the invention relates to a method of replacing seals in an air swivel ring that includes removing a non-rotating member from the air swivel ring, removing a first split seal from a rotating member of the air swivel ring, installing a second split seal in the rotating member of the air swivel ring, and replacing the non-rotating member of the air swivel ring.

In some embodiments the invention relates to an actuator that includes an actuator housing, at least one clamp configured to be releasably coupled to the actuator housing, at least one air vane motor disposed in the actuator housing, and a drive gear operatively engaged with the at least one air vane motor and adapted to be coupled to a drive shaft.

In other embodiments the invention relates to a method of installing an actuator on an internal drill string blowout preventer that include locating an actuator housing so a drive shaft in the actuator housing is coupled to the internal drill string blowout preventer, and coupling at least one clamp to the actuator housing so that the actuator housing is retained in place on the internal drill string blowout preventer.

Other aspects and advantages of the invention will be apparent from the following description and the appended claims.

DETAILED DESCRIPTION

Figure 1:
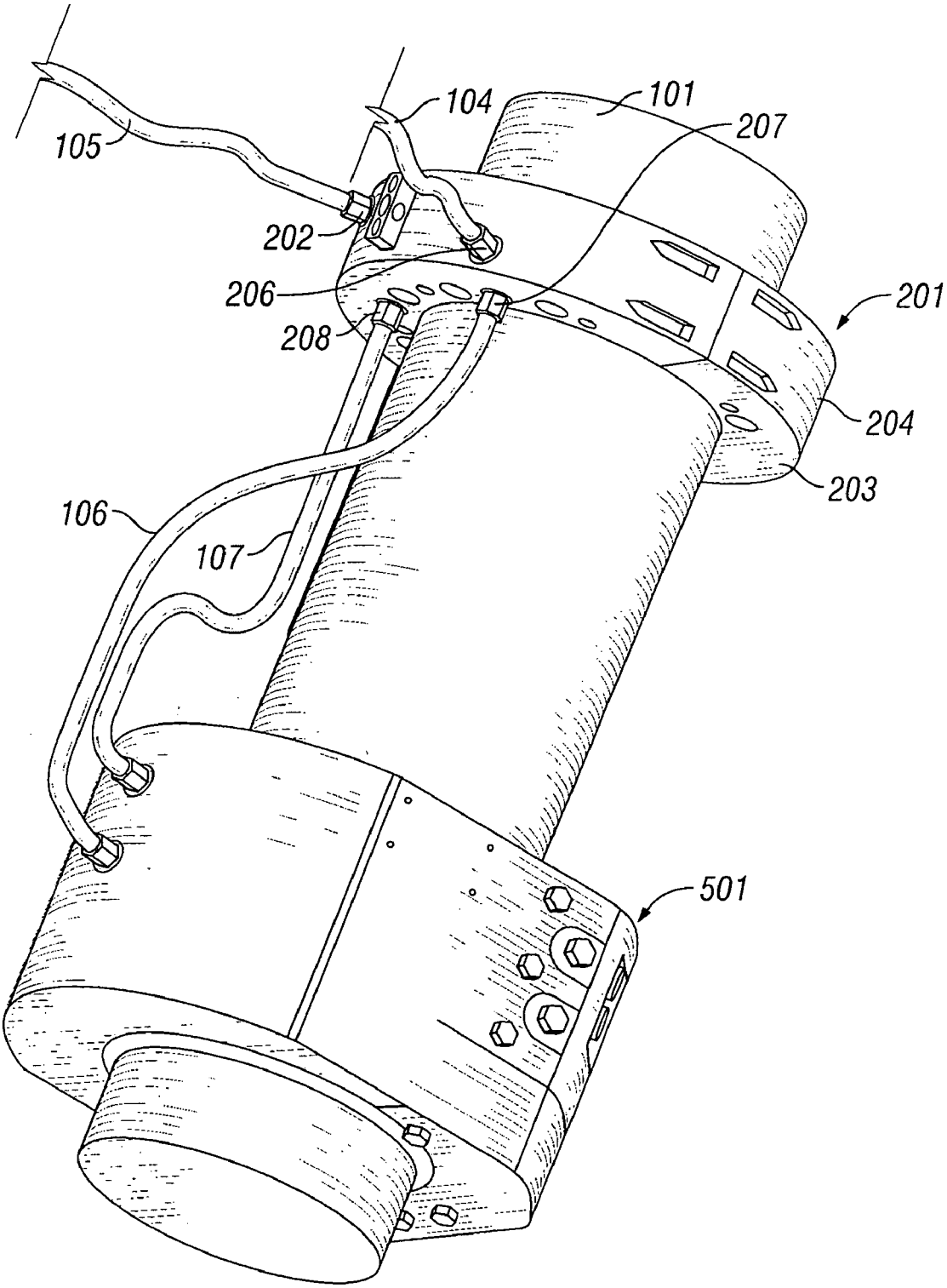
FIG. 1 is a perspective view of a split swivel air ring and an actuator positioned on a internal drill string blowout preventer in accordance with one embodiment of the invention.

Embodiments of the present invention relate to a system and method for remotely actuating an internal blowout preventer ("IBOP") of a drill string. Illustrative embodiments of the invention will now be described with reference to FIGS. 1–7, wherein like reference characters are used to denote like parts throughout the views.

FIG. 1 is a perspective view of a split air swivel ring 201 and an actuator 501 on an internal drill string blowout preventer ("IBOP") 101 in accordance with one embodiment of the invention. The IBOP 101 may be any type of device that can isolate the inside of the drill string so that fluids may not pass through the IBOP 101. Typically, an IBOP 101 is a ball valve with a casing that is adapted to be in threaded connection with the drill string. Other types of valves may be used as an IBOP. FIG. 1 shows an IBOP 101 that is adapted to be connected in-line with a drill string. The valve mechanism is located inside in IBOP 101. The IBOP actuator 501 is positioned around the IBOP 101 so that the actuator 501 may actuate the IBOP 101 when desired.

The IBOP 101 is typically located in-line with the drill string (not shown). The IBOP 101 may be connected at its lower end such that the IBOP 101 would form the top end of the drill string. In other embodiments, the IBOP 101 may be connected at both ends such that it forms a segment of the drill string. In such a configuration, the IBOP 101 may be lowered into the well, if necessary during drilling or tripping.

During normal drilling operations, the drill string (not shown) is rotated, and the IBOP 101 rotates with the drill string. The IBOP actuator 501 is coupled to the IBOP 101, and the actuator 501 also rotates with the drill string. The split air swivel ring 201 is used to transmit pneumatic power from a stationary source to the rotating actuator 501.

In the embodiment shown in FIG. 1, the swivel ring 201 includes a non-rotating member 204 and a rotating member 203. The rotating member 203 rotates with the IBOP 101 and the rest of the drill string (not shown), while the non-rotating member 204 is typically tied back so that it remains stationary relative to the drilling rig (not shown). Pneumatic power may be transferred into the non-rotating member 204 through air inlet hoses 104, 105. The inlet hoses 104, 105 are coupled to the swivel ring 201 at an inlet ports 202, 206.

One or more transfer hoses 106, 107 transfer pneumatic power from the swivel ring 201 to the actuator 501. The transfer hoses 106, 107 are coupled to outlet ports 207, 208, respectively, in the rotating member 203 of the swivel ring 201. The rotating member 203 of the swivel ring 201 and the actuator 501 each rotate with the IBOP 101, and are stationary relative to each other. The transfer hoses 106, 107 couple the swivel ring 201 and the actuator 501 so that pneumatic power may be transferred between the swivel ring 201 and the actuator 501. The split air swivel ring 201 transfers pneumatic power from a non-rotating source (not shown) to the rotating IBOP actuator 501.

Figure 2:
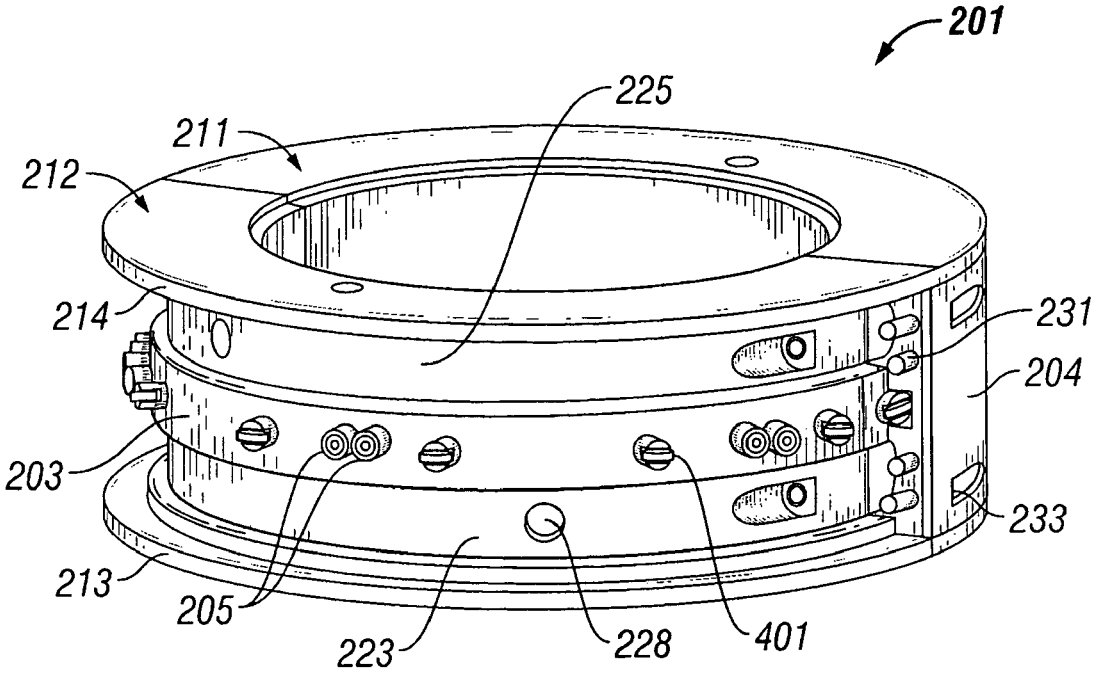
FIG. 2 is a cutaway perspective view of a split air swivel ring in accordance with one embodiment of the invention.

FIG. 2 shows a perspective view of a swivel ring 201 according to one embodiment of the invention. The swivel ring 201 is a "split" ring that includes two semi-circular halves 211, 212. The two halves 211, 212 of the swivel ring 201 may be installed onto a section of pipe or an IBOP (e.g., 101 in FIG. 1) without having to pass the swivel ring 201 over an end of the pipe. For simplicity, FIG. 2 shows a swivel ring 201 that includes only two split sections (i.e., 211, 212), although a swivel ring may include more than two sections, and the sections may have a shape other than a semi-circular shape. While a swivel ring is generally described herein as a "split" ring, some embodiments of the invention include a non-split swivel ring. Certain advantages of the invention may be realized even with a non-split ring. Those having ordinary skill in the art will realize that different embodiments of a swivel ring may be devised that do not depart from the scope of the invention.

The swivel ring 201 shown in FIG. 2 is comprised of a rotating split inner ring (i.e., rotating member 203), a stationary split outer ring (i.e., non-rotating member 204) and two split end caps 213, 214. The "rotating member" is named that way because it rotates with respect to the drilling rig—that is, it rotates with the drill string. The "non-rotating member" does not rotate with respect to the drilling rig. Those having ordinary skill in the art will realize that other names may be given to the various components of the invention. The names given to the various parts are not intended to limit the invention.

It is noted that FIG. 2 shows a non-rotating member 204 on only one half 211 of the swivel ring 201. The other half 212 of the swivel ring 201 is shown without a non-rotating member to illustrate the internal mechanisms of the swivel ring 201. During normal operation, a swivel ring includes a non-rotating member (e.g., as shown at 204) on both halves.

Each half of the rotating member 203 may be aligned with dowel pins 231 and fastened together with bolting (bolt holes are shown at 233). Each half of the non-rotating member section 204 may be aligned and fastened in the same manner. The split end caps 213, 214 may be fastened to the rotating member 203 with screws (not shown). The end caps 213, 214 may be fastened in any manner known in the art. In some embodiments, the end caps 213, 214 are formed integral with the rotating member 203.

In the embodiment shown in FIG. 2, the rotating member 203 of the swivel ring 201 includes two seal grooves, an upper seal groove 225 and a lower seal groove 223. The seal grooves 223, 225 are configured so that a seal (not shown) may be disposed in the grooves to seal against the non-rotating section 204. In some embodiments, the seal grooves 223, 225 are configured to receive a double seal in the form of two split seal rings, as will be described later with reference to FIGS. 3A, 3B, and 3C. The grooves 223, 225 also have air passageways (i.e., passage 228 in lower seal groove 223) that enable air to pass into an inner cavity (not shown) of the rotating section 203 where the air may pass out of the swivel ring 201 through outlet ports (e.g., 207, 208 in FIG. 1) in the rotating member 203.

Figure 3A:
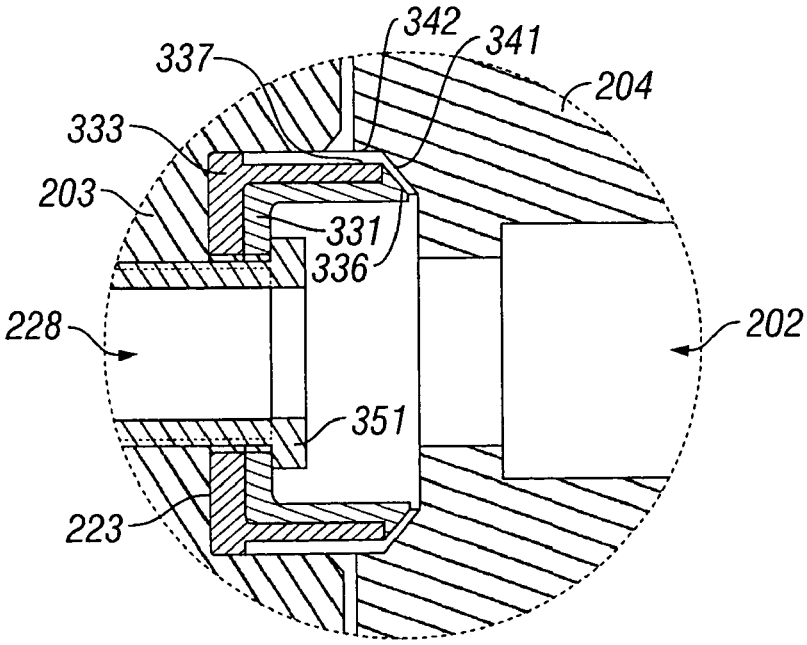
FIG. 3A is a cross section of a sealing portion of a split air swivel ring in accordance with one embodiment of the invention.

FIG. 3A shows a cross section of a seal groove 223 in a swivel ring (e.g., 201 in FIG. 2). The groove 223 is disposed in the rotating member 203, and a double seal, comprised of an inner seal member 331 and an outer seal member 333, is disposed in the groove 223. The seals 331, 333 are retained in position by one or more bolts 351. In some embodiments, such as the one in FIG. 3A, the bolt 351 is a hollow bolt that enables air to pass through the bolt 351 and air passage 228.

A non-rotating member 204 is positioned in the swivel ring (201 in FIG. 1) so that the seals 331, 333 will be able to seal against the non-rotating member 204. As shown in FIG. 3A, the seals 331, 333 may be generally U-shaped so that sealing surfaces 336, 337 are positioned proximate sealing surfaces 341, 342 on the non-rotating section 204. In some embodiments, when the seal a relaxed state, the sealing surfaces 336, 337 on the seals 331, 333 do not need to contact the sealing surfaces 341, 342 on the non-rotating member 204. This enables the relative rotation of the rotating member 203 and the non-rotating member 204 during normal conditions without wearing the seals 331, 333 and causing additional torque due to seal friction. The sealing characteristics of the lower portion of the U-shaped seal is substantially the same as that of the upper portion, and the lower portion will not be separately described or shown.

Pressurized air enters the swivel ring (201 in FIG. 2) through an inlet port in the non-rotating member 204, such as port 202. The inlet port 202 is positioned so that air will enter the swivel ring proximate a seal groove (e.g., groove 223). As will be described later with reference to FIG. 3B, the pressurized air may cause the seals 331, 333 to deflect so that the sealing surfaces 336, 337 on the seals 331, 333 will be in contact with the sealing surfaces on the non-rotating section 204. With the sealing surfaces in contact (336 & 341; 337 & 342), the pressurized air is directed through the hollow bolt 351 positioned in the air passage 228 with minimal leakage through the split seal.

Once the pressurized air passes through the air passage 228 and into an inner cavity (not shown) of the rotating member 203, it may be channeled through various passages (not shown) in the rotating member 203 and directed out through an outlet in the rotating member 203 (e.g., hoses 106, 107 in FIG. 1 are connected to outlets 207, 208 of the swivel ring 201).

Figure 3B:
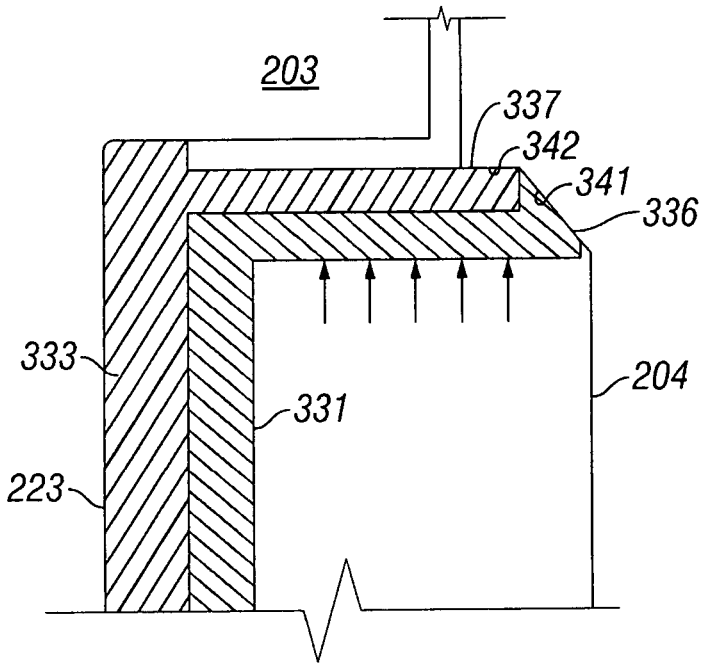
FIG. 3B is a cross section of an engaged sealing portion of a split air swivel ring in accordance with one embodiment of the invention.

FIG. 3B shows a cross section of a seal groove 223 when supplied with pressurized air. The pressure (shown as upward force arrows against the inner seal 331) forces the seals 331, 333 to deflect until the seals 331, 333 contact the non-rotating member 204. The outer seal 333 deforms so that the sealing surface 337 on the outer seal 333 is in contact with the sealing surface 342 on the non-rotating member 204. Similarly, the inner seal 331 deforms so that the sealing surface 336 on the inner seal 331 is in contact with the sealing surface 341 on the non-rotating member 204. With the sealing surfaces 336, 337 of the seals 331, 333 in contact with the sealing surfaces 341, 342 of the non-rotating member 204, the pressurized air will be forced through the air passage (228 in FIGS. 1 and 3A), as described with reference to FIG. 3A.

The seals 331, 333 may be selected to have a specific hardness, or durometer, to suit the particular application. For example, in some embodiments, the outer seal 333 has a higher durometer than the inner seal 331. The lower durometer of the inner seal 331 provides better sealing characteristics, and the higher durometer of the outer seal 333 prevents the outer seal 333 from being extruded into the gap between the rotating member 203 and the non-rotating member 204 when pressurized air is applied. The durometer of each seal may be selected to suit a particular application, and it is not intended to limit the invention.

Figure 3C:
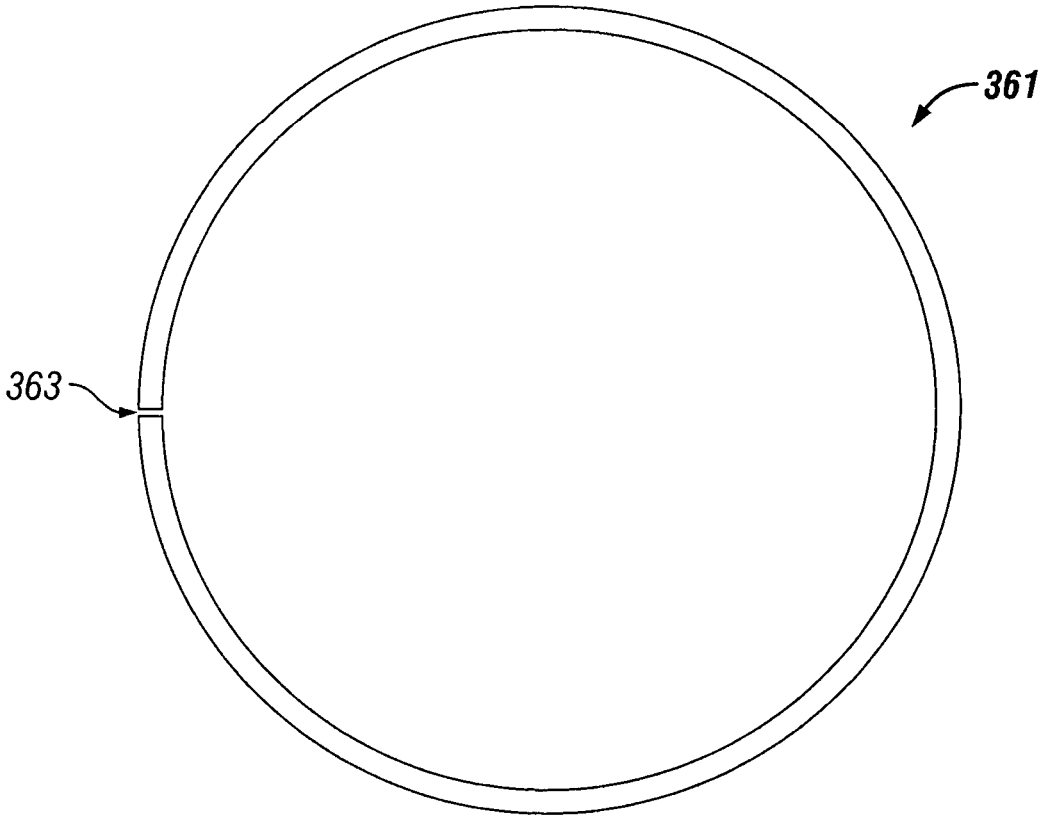
FIG. 3C is a cross section of a seal in accordance with one embodiment of invention.

FIG. 3C shows a perspective view of a split seal 361 in accordance with one embodiment of the invention. The seal 361 shown in FIG. 3C may be either an inner seal (e.g., 331 in FIG. 3A) or an outer seal (e.g., 333 in FIG. 3A). The seal 361 has one split 363 around its circumference. The split 363 in the seal 361 enables the seal to be installed in a swivel ring (e.g., 201 in FIGS. 1 and 2) without having to pass the seal 361 over an end of the drill pipe. A split seal 361 will also enable easy replacement of a worn seal without having to remove the entire swivel ring (e.g., 201 in FIGS. 1 and 2) from the drill string.

A swivel ring (e.g., 201 in FIG. 2) in accordance with the invention may have a double seal arrangement, as shown in FIGS. 3A and 3B. In some embodiments, the split (e.g., 363 in FIG. 3C) in the inner seal (e.g., 331 in FIG. 3A) is positioned 180° apart from the split (e.g., 363 in FIG. 3C) in the outer seal (e.g., 333 in FIG. 3B). This enables both seals to be easily installed in a swivel ring while still providing at least one sealing surface at all points around the swivel ring.

Additionally, a swivel ring may be devised that uses only one seal. For example, a single split seal may be designed to overlap near the split in the seal. In other embodiments, the seals may be coupled to the rotating member using solid screws, and separate holes may be provided to enable air to pass to the interior of the rotating member. In other embodiments, the U-shaped seals may be replaced with separate upper and lower seals that seal against the non-rotating member. Some embodiments of a swivel ring include only one seal groove. Any of the above mentioned embodiments of a seal may be used with a single seal groove.

Referring to FIG. 2, the rotating section 203 may include radial bearings 401 and axial thrust bearings 205 that facilitate the relative rotation between the rotating member 203 and the non-rotating member 204. The axial thrust bearings 205 prevent the non-rotating member 204 from moving in the axial direction with respect to the rotating member 203. The radial bearings 401 enable easier rotation between the rotating member 203 and the non-rotating member 204, and the radial bearings act against any radially inward forces that are applied to the non-rotating member 204. In some embodiments, the radial bearings 401 comprise wheel bearings. Those having skill in the art, however, will realize that an alternate type of radial bearing may be used without departing from the scope of the invention.

Figure 4:
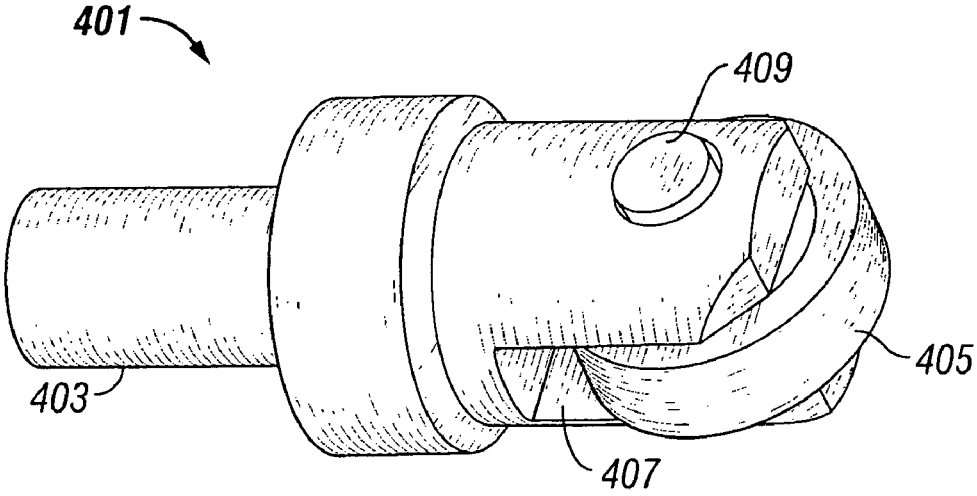
FIG. 4 is a perspective view of a wheel bearing for a split swivel air ring in accordance with one embodiment of the invention.

FIG. 4 shows a perspective view of one embodiment of a radial bearing 401 that may be used with the invention. As shown in FIG. 2, a plurality of radial bearings 401 may be positioned in the swivel ring 201 to apply radial support to the stationary split ring 204. For example, the radial bearings 401 may be positioned between the upper seal groove 225 and the lower seal groove 223.

Referring again to FIG. 4, a radial bearing 401 includes a base 403 that may be inserted into a swivel ring (e.g., 201 in FIGS. 1 and 2) to hold the radial bearing 401 in position. An opposite end of the radial bearing 401 includes a slot 407 where a wheel 405 is held in place by a pin 409. When a radial bearing 401 is positioned in a rotating section of a swivel ring, the wheel 405 is positioned to contact the non-rotating section (e.g., 204 in FIG. 2) to facilitate the relative motion between the rotating section and the non-rotating section (e.g., 203 and 204 in FIG. 2). The radial bearing 401 may be spring loaded (not shown) to compensate for any cylindrical irregularities of the non-rotating section 204. An alignment feature and retention device may be used to prevent the radial bearing 401 from rotating on its axis to ensure proper orientation of the wheel 405.

Those having skill in the art will realize that the radial bearing 401 could be positioned in a non-rotating member so that the wheel contacts the rotating member. Such a configuration is simply a design choice and does not depart from the scope of the invention. A segmented plain bearing may also be used to apply radial support between the non-rotating member and the rotating member. The type of bearings used with a swivel ring is not intended to limit the invention.

Figure 5:
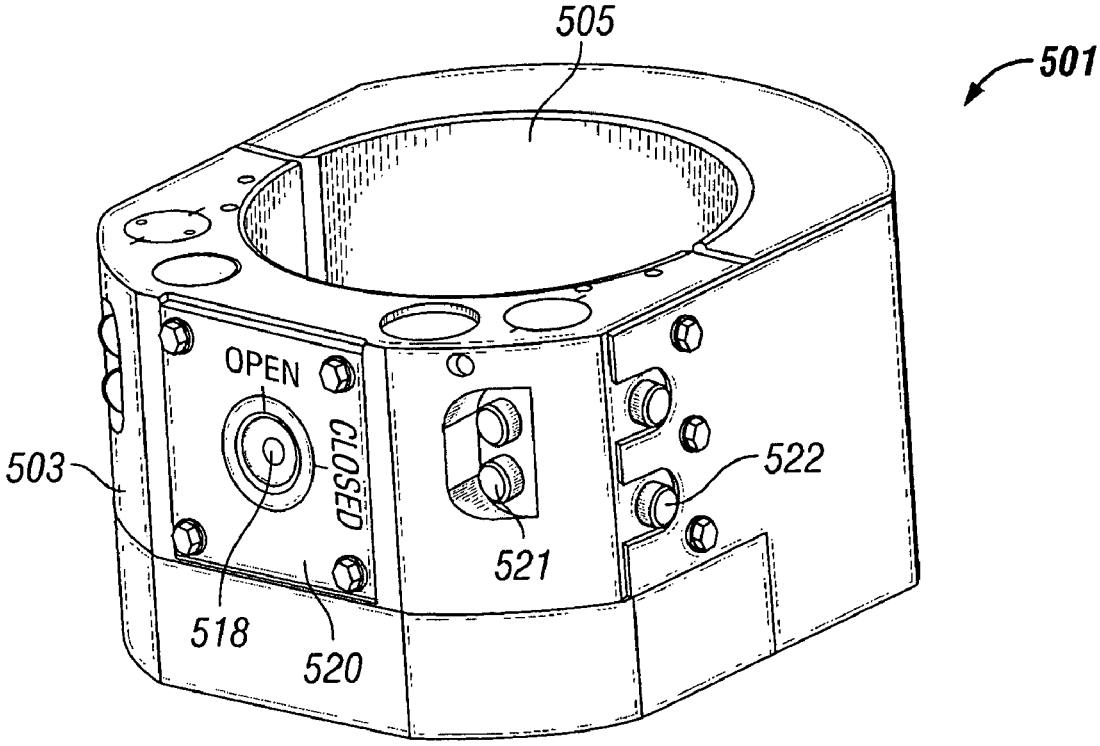
FIG. 5 is a perspective view of a split IBOP actuator in accordance with one embodiment of the invention.

FIG. 1 also shows an IBOP actuator 501. An air hose 106, 107 pneumatically couples the swivel ring 201 to an IBOP actuator 501 that uses pneumatic power to actuate an IBOP 101. FIG. 5 is a perspective view of an IBOP actuator 501 in accordance with one embodiment of the invention. The actuator 501 includes an actuator housing 503 and a clamp 505. The clamp 505 may be fastened to the actuator housing 503, for example with bolts (not shown). The clamp plate 505 enables the actuator 501 to be installed on a drill stem valve (e.g., 101 in FIG. 1) by placing the actuator housing 503 on the drill stem valve 101 and fastening the clamp 505 to the actuator housing 503.

The IBOP actuator includes a cover plate 520 that holds a drive shaft 518 in place. The cover plate 520 may also include markings to indicate the position of the IBOP (501 in FIG. 1). In some embodiments, the IBOP actuator includes a drive shaft 518 that couples to the IBOP (101 in FIG. 1) to actuate the IBOP. In some other embodiments, the IBOP includes a shaft that engages a drive gear (described later in more detail with reference to FIG. 7) in the IBOP. A drive shaft may not form part of either the IBOP or the IBOP actuator. Instead, the drive shaft may be a separate piece that is used to connect the IBOP to the IBOP actuator.

Figure 7:
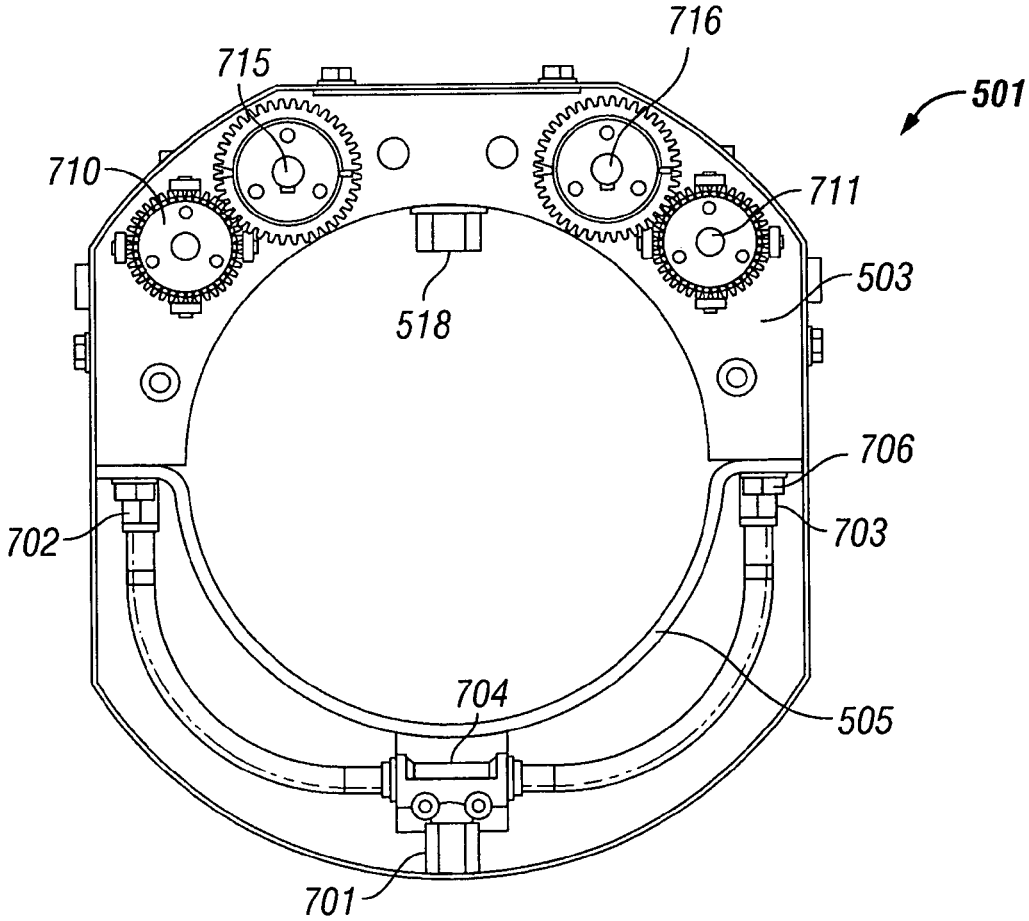
FIG. 7 shows a cross section of an IBOP in accordance with one embodiment of the invention.

FIG. 7 shows a cross section of an IBOP actuator 501 in accordance with one embodiment of the invention. The clamp plate 505 includes an air inlet port 701 that is connected to a split tee 704 that divides the air stream into two paths. One path leads to a first supply port 702, and the other path leads to a second supply port 703. The operation of one side of the IBOP actuator 501 will be described. It will be understood that the operation of the other side is substantially the same.

Air that enters through supply port 702 is directed to a reversible vane air motor 711. The air passing through the air motor 711 causes the air motor 711 to rotate with respect to the IBOP actuator 501. The air may be exhausted through an exhaust port (e.g., port 521 in FIG. 5) in the IBOP actuator 501. As will be described with reference to FIG. 6, the rotation of the air motor 711 causes a corresponding rotation in the worm gear 715 coupled to the air motor 711, which, in turn, drives a drive gear (621 in FIG. 6). The drive gear is coupled to the drive shaft 518 that actuates the IBOP (101 in FIG. 1).

It is noted that an actuator may not include a split tee or even an inlet on the clamp plate. For example, an air hose may be connected directly to one or more air motors in the actuator. The description of an inlet with a split tee is intended to show only one example of an IBOP actuator in accordance with the invention.

Figure 6:
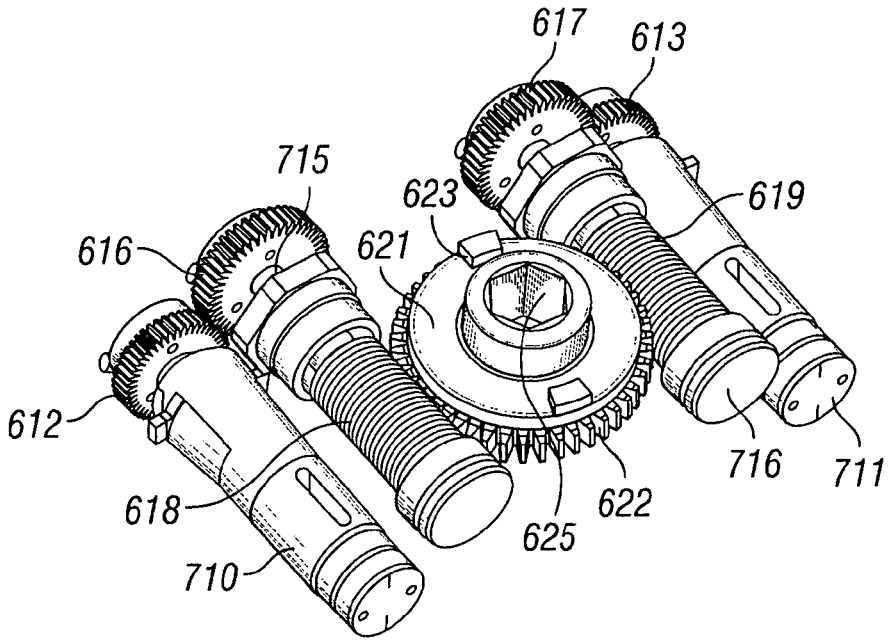
FIG. 6 shows a drive mechanism of an IBOP actuator in accordance with one embodiment of the invention.

FIG. 6 shows a perspective view of the internal mechanisms of an IBOP actuator (e.g., 501 in FIG. 5) without the surrounding casing. When pressurized air is supplied to the air motors 710, 711, pneumatic energy is converted into rotary motion of the air motors 710, 711. Gears 612, 613 on the air motors 710, 711 are coupled to gears 616, 617 on worm gears 715, 716. The rotation of the air motors 710, 711 causes a corresponding rotation in the worm gears 715, 716. The worm gears 715, 716 include helical grooves 618, 619 that are coupled to teeth 622 on the opposite side of the drive gear 621. The rotation of the worm gears 715, 716, which are oriented in a direction perpendicular to the drive axis, causes the drive gear 621 to rotate along the drive axis.

In this respect, the air motors are "operatively coupled" to the drive gear. That is, when the air motors rotate, they cause a corresponding rotation in the drive gear. The air motors may be operatively coupled to the drive gear by being directly coupled to the drive gear, or the air motors may be operatively coupled by interposing one or more additional gears or worm gears, one embodiment of which is described above.

A connector 625 may be coupled to the drive gear 621 so that it extends radially inward with respect to the IBOP (101 in FIG. 1). When the IBOP actuator (e.g., 501 in FIG. 5) is installed on an IBOP (e.g., 101 in FIG. 1), the connector 625 may be coupled to a drive shaft (e.g., 518 in FIG. 7) to open and close the valve. The drive gear 621 has two end stops 623 that contact corresponding stops on the drive gear cover plate (520 in FIG. 5). End stops 623 are used to prevent the actuator from over torquing the IBOP and damaging the IBOP.

The IBOP actuator mechanisms shown in FIG. 6 include two air motors. In some embodiments, an IBOP actuator may include only one air motor and the corresponding gears. In other embodiments, an IBOP actuator may include more than two air motors. In some embodiments, an air motor may include a helical groove and be directly coupled to the drive gear, without the use of a worm gear.

The IBOP may be manually operated by removing the drive shaft (518 in FIG. 5.) and installing a socket that connects to the IBOP 101 shaft when pneumatic power is not available. In some embodiments, manual operation may be achieved by a ratchet device that decouples the actuator from the IBOP while keeping the drive shaft 518 in place.

The various embodiments of the invention may include one or more of the following advantages. A split air swivel ring enables the transmission of pressurized air from a stationary air source to a rotating actuator. A split air swivel ring may be easily installed and removed from a drill string. A split air swivel ring with split seals may enable the easy replacement of the seals without having to disassemble or remove the entire split air swivel ring. Redundant seals with opposing splits enable a reduced leakage path at the split. The relative motion of each seal and dual contact points reduce seal leakage.

The split actuator may be easily installed and removed from an IBOP. The worm gear design provides high torque, which enables the use of a single crank valve. The use of worm gears also prevents the IBOP from back driving the actuator during drilling (e.g., rotation of the IBOP can only occur using the actuator). This prevents the IBOP from inadvertently closing from rotation and vibration of the drill string during drilling.

Advantageously, a split air swivel ring having a U-shaped seal in accordance with one or more embodiments of the invention may minimize the contact between the sealing surface on the seal and a sealing surface in the swivel ring. This will reduce the wear on the seal caused by the relative rotation between the parts of the split air swivel ring. Reduced wear will increase seal life and reduce the maintenance costs associated with a swivel ring.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An actuator, comprising:

an actuator housing;

at least one clamp configured to be releasably coupled to the actuator housing;

at least one air vane motor disposed in the actuator housing; and a drive gear operatively coupled with the at least one air vane motor and adapted to be coupled to a drive shaft.

2. The actuator of claim 1, further comprising at least one worm gear having a helical groove disposed in the actuator housing, operatively coupled with the at least one air vane motor and wherein the helical groove is operatively coupled with teeth on the drive gear.

3. The actuator of claim 2, wherein the at least one air vane motor comprises two air vane motors, wherein the at least one clamp comprises one substantially semi-circular clamp having an air inlet, an air splitter, and two air passageways that lead to the two reversible air vane motors when the clamp is coupled to the actuator housing.

4. The actuator of claim 1, wherein the at least one air vane motor comprises two reversible air vane motors.

5. The actuator of claim 1, further comprising at least one stop configured to prevent over torquing of the drive shaft.

6. The actuator of claim 1, further comprising a cover plate on an outward end of the drive gear, wherein the coverplate comprises a position indicator.

7. The actuator of claim 6, wherein the cover is removable.

8. A method of installing an actuator on an internal drill string blowout preventer, comprising:

locating an actuator housing so that a drive shaft in the actuator housing is coupled to the internal drill string blowout preventer; and coupling at least one clamp to the actuator housing so that the actuator housing is retained in place on the internal drill string blowout preventer.

9. The method of claim 8, further comprising operatively connecting an air supply hose to an air motor disposed in the actuator housing.

* * * * *